US006019157A

United States Patent [19]

Kanno et al.

[11] Patent Number: 6,019,157

[45] Date of Patent: Feb. 1, 2000

[54] METHOD OF REGENERATING FOUNDRY SAND

[75] Inventors: Toshitake Kanno; Tomohisa Kawaji, both of Shizuoka, Japan

[73] Assignee: Kimura Chuzosho Co., Ltd., Shizuoka, Japan

[21] Appl. No.: 08/836,367

[22] PCT Filed: Jan. 19, 1996

[86] PCT No.: PCT/JP96/00081

§ 371 Date: May 13, 1997

§ 102(e) Date: May 13, 1997

[87] PCT Pub. No.: WO97/26097

PCT Pub. Date: Jul. 24, 1997

[51] Int. Cl.[7] ..... B22C 25/00; B22D 45/00

[52] U.S. Cl. ..... 164/5; 164/465

[58] Field of Search ..... 164/5, 465; 194/5; 110/236; 48/210; 196/116

[56] References Cited

U.S. PATENT DOCUMENTS

| | | | |
|---|---|---|---|
| Re. 33,537 | 2/1991 | Hiramatsu et al. | 423/447 |
| 4,437,834 | 3/1984 | Vogel | 164/456 |
| 4,443,183 | 4/1984 | Shimizu et al. | 431/354 |
| 4,461,629 | 7/1984 | Arisaki | 48/210 |
| 4,563,151 | 1/1986 | Vogel | 164/5 |
| 4,600,572 | 7/1986 | Hiramatsu et al. | 423/447 |
| 4,637,925 | 1/1987 | Hiramatsu et al. | 423/447 |
| 5,090,233 | 2/1992 | Kogure et al. | 73/28.05 |
| 5,271,450 | 12/1993 | Bailey | 164/5 |
| 5,363,779 | 11/1994 | Bury | 110/236 |
| 5,584,969 | 12/1996 | Nagai et al. | 196/116 |

FOREIGN PATENT DOCUMENTS

| | | |
|---|---|---|
| 57-127437 | 8/1982 | Japan . |
| 60-18251 | 1/1985 | Japan . |
| 5-293588 | 11/1993 | Japan . |
| 6-322450 | 11/1994 | Japan . |

*Primary Examiner*—Patrick Ryan
*Assistant Examiner*—Anjan Dey
*Attorney, Agent, or Firm*—Townsend and Townsend and Crew LLP

[57] ABSTRACT

The present invention aims to provide a method of regenerating foundry sand whereby the carbon component adhering to the surface of spent foundry sand and similar substances is combusted efficiently, allowing the foundry sand to be regenerated at low cost. In the present invention, in order to achieve this aim the spent foundry sand with the carbon component adhering to it is placed in a combustion furnace which is connected on one side to a pressure-reducing pump and is open on the other, the pressure-reducing pump is operated to draw air from within the foundry sand and introduce air into it, and the accretion is ignited upwind of the current of air which is being introduced, allowing combustion of the accretion to proceed successively on the downwind side. Foundry sand can thus be recycled at very low cost, simply and reliably because it is allowed to self-combust continuously without any heating or agitation from elsewhere, and because the resin is combusted entirely.

11 Claims, 3 Drawing Sheets

METHOD OF REGENERATING FOUNDRY SAND

TECHNICAL FIELD

The present invention relates to a method of regenerating spent foundry sand which has adhering to its surface, resins employed in order to maintain the shape of the mould and more particularly to a method of regenerating wherein it is processed by combusting these resins, and further to a method of combusting whereby other waste and similar products are combusted effectively.

BACKGROUND ART

Certain types of foundry sand used in shaping moulds have several weight percent of resin added for the sake of its adhesive properties. Such foundry sand retains the shape of the mould after moulding on account of the caking force of the resin. However, the heat of the molten metal when it is poured into the mould causes the resin to carbonise and adhere to the surface of the foundry sand. The carbonised accretion adheres firmly to the sand and creates problems in that, among other things, regenerating the foundry sand in this state by adding fresh resin causes the resin content to increase, resulting in defects in the finished mould.

Consequently, if spent foundry sand is to be re-used, it is necessary to remove the accretion (carbonisation) adhering to it.

Conventional methods of regenerating whereby the accretion is removed from the foundry sand, which is then regenerated, include the following:

(1) Mechanical method whereby the accretion is removed from the foundry sand by applying friction though rubbing the sand together or on to rollers, or by beating the sand with an impeller or similar device and crushing the accretion by means of the impact.

(2) Fluidised roasting furnace method whereby the accretion is removed from the surface of the foundry sand by applying flames from a burner and combusting it within a fluidised roasting furnace, the foundry sand being fluidised by blowing air from beneath.

(3) Kiln baking method whereby the accretion is combusted and removed using a rotary or similar kiln to heat the sand with a burner from above or below while rotating it or otherwise causing it to move.

Nevertheless, while the mechanical method of regenerating has the advantage that the equipment used is relatively compact in comparison with that used for regenerating by combusting, it has proved difficult to remove the accretion totally even with long processing because it is burnt firmly on to the surface of the sand and a residue remains there after mechanical processing. For this reason it has not been possible to use the processed sand as if it were fresh.

In this respect, methods whereby the accretion is removed by combusting are preferable because the accretion, consisting as it does of carbides, is itself combustible and can be processed totally. However, were it just a matter of the accretion, its combustible components would be capable of self-combustion, but the amount of the accretion is only a small percentage of that of the foundry sand. As a result, the heat of combustion is almost all absorbed by the foundry sand before combusting the accretion: even if it ignites, it fails to combust continuously in a state of self-combustion.

It has therefore been normal to apply external heat as in the fluidised roasting furnace method and the kiln baking method, and to cause the foundry sand to rise or to move by means of a motor or other device.

Thus, in the case of the fluidised roasting furnace method, the foundry sand is roasted while a current of air causes it to flow within the furnace, as a result of which it is necessary for the flames of the burner to be applied constantly to the foundry sand. Moreover, a large amount of heat is required to heat the air which is injected into the furnace for the purpose of fluidising the sand. Most of the thermal energy supplied by the burner is used not for heating the foundry sand but for heating the air in order to fluidise the sand, with the resultant problem that thermal efficiency is low while the cost involved in regenerating is high and the apparatus cumbersome. Methods have been devised, for instance, whereby in order to provide a solution to the problem of thermal efficiency a heat-exchanger is fitted which preheats the air used for fluidisation (Japanese Patent SHO 64-2462), but they have not proved very effective.

The kiln baking method causes the accretion to combust forcibly by applying a burner while moving the sand. It requires a great deal of motive power in order to move all the sand, with the resultant problem that the apparatus is unwieldy and equipment costs are enormous. Moreover, fluidity of the grains of sand within the kiln is poor, so that while it is possible to combust the accretion in the vicinity of the burner and on the surface layer where the flames of the burner reach directly, the parts which do not come into contact with the flames become oxygen-deficient and the accretion simply undergoes thermal decomposition, the resultant compounds with a large number of carbon atoms adhering to the surface of the sand.

DISCLOSURE OF THE INVENTION

In the present invention, the pressure on one side within a combustion furnace containing foundry sand is reduced, while the foundry sand within the furnace on the side where the pressure is not reduced is ignited, air being introduced into the furnace from the latter side in such a manner as to combust any accretion adhering to the foundry sand. This ensures continuous self-combustion of the accretion, making it possible to remove it completely. Foundry sand can thus be regenerated at very low cost, efficiently and reliably without injecting air or moving the foundry sand in order to fluidise it, and with minimum feasible use of a burner.

Moreover, the present invention may be applied not only to foundry sand, but to processing paper, wood, plastic and other waste materials by incineration.

Air is introduced into the furnace preferably by reducing the pressure, but this may also be achieved by boosting the pressure on the side where the air is introduced. It is also possible to reduce or increase pressure on opposite sides. Whichever means is adopted, it is not accompanied by any movement of the foundry sand such as causing it to rise or fluidising it. The direction in which the air is introduced into the furnace may be either vertical or horizontal, from the inside outwards or from the centre towards the perimeter. Moreover, the combustion furnace need not be rectangular or cylindrical in shape, but may also for instance be conical or ring-shaped.

The foundry sand is ignited upwind of where the air is introduced. Ignition is implemented by means of a burner or other heating means. Basically speaking the foundry sand is not heated after ignition, but heat may be applied as necessary. Application of external heat allows the rate of combustion to be speeded up, shortening the time required for processing. Reducing pressure at the time of ignition allows flames to be introduced within the foundry sand, thus ensuring effective ignition. If the air is introduced under reduced pressure through a high-temperature member into the furnace, it passes through the foundry sand and combustion proceeds only in the direction in which the air flows. Reducing pressure is the most desirable way of creating this sort of uniform airflow, but it is also possible to introduce the air within the foundry sand under increased pressure, thus ensuring self-combustion.

It need not be air within the combustion furnace, and it may also be a gas containing oxygen. Effective combustion may be achieved by altering the partial pressure of oxygen within the gas as necessary in view of the proportion of the accretion and other factors.

If pressure is reduced and air is extracted from within the combustion furnace, the extracted air may be cooled as necessary. On the other hand, it has become clear that where the accretion adhering to the surface contains a certain amount of carbon constituents, the air which is extracted from within the furnace is not heated, and therefore does not require any cooling. This is thought to be because the carbon constituents absorb the heat of the combustion gas.

It is more effective to adopt a continuous method rather than a repeated batch method when regenerating foundry sand. For instance it can be set up in a simple manner with reduced pressure at the top, so that the gas is introduced from the bottom, self-combustion proceeds from the bottom towards the top, foundry sand whereof combustion is complete is extracted from the bottom, and replenished from the top. In this manner it is possible to achieve continuous regenerating of foundry sand. Moreover, by adjusting the degree of reduced pressure within the combustion furnace it is also possible to extract sand from the bottom at will. That is to say, inasmuch as the pressure is reduced within the combustion furnace, upward suction force added to the bridge effect of the foundry sand particles prevents the sand from falling down. However, opening the aperture through which the sand is replenished lessens the degree of reduced pressure within the furnace, the upward suction force is reduced, the bridging effect destroyed, and foundry sand from which the accretion has been removed falls down naturally.

Furthermore, reduced pressure within the combustion furnace allows smooth replenishment of foundry sand through the aperture provided for that purpose. In addition, the fact that the aperture for replenishing the foundry sand and the pressure-reduction aperture are located in a prescribed spatial relationship to each other means that fine powder in the foundry sand which is fed in can be drawn out through the pressure-reduction aperture, thus separating the foundry sand from the fine powder, which is not used.

If the particles of foundry sand are coated with bentonite and other viscous substances in the same way as green sand, they react with the bentonite at high combustion temperatures, and for the purpose of temperature adjustment the proportion of accretion to foundry sand has therefore been set at a prescribed level. The proportion can be set by mixing into the unprocessed foundry sand suitable amounts of processed sand, fresh sand or foundry sand with differing carbon contents in order to reduce the content of the whole.

The direction of combustion may also be set cylindrically. Since combustion in the present invention is self-combustion, it follows that the speed of combustion is governed by the speed of self-combustion, and this cannot be accelerated excessively. The amount of combustion per unit hour is increased by allowing combustion to proceed cylindrically rather than in a direct line upwards or downwards. That is to say, combustion of the foundry sand is made to occur cylindrically by placing at least one gas inlet in the central section of the furnace, placing a pressure-reducing member on the outer perimeter or outside the furnace, and igniting the foundry sand through the air inlet section. In this way the area of combustion increases in proportion to the square of the radius, and it is possible to increase the amount of combustion per unit hour with the passage of time, thus accelerating the rate of processing. It is also possible to construct the combustion furnace in the shape of a cone or pyramid, to ignite the sand at the end with the smaller cross-sectional area, and to allow combustion to proceed in the direction of the end with the larger cross-sectional area.

BEST MODE FOR CARRYING OUT THE INVENTION

Figure 1:
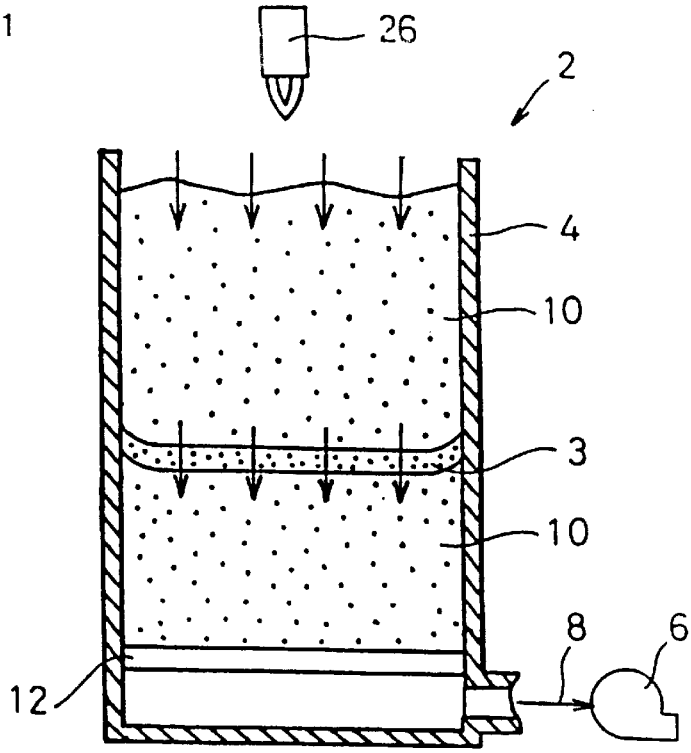
FIG. 1 is a cross-sectional diagram illustrating an embodiment of a regenerating device for the purpose of implementing the method of regenerating to which the present invention pertains.

FIG. 1 shows an embodiment of a combustion furnace 2 for the purpose of implementing the present invention. The combustion furnace 2 comprises a principal member 4, which is constructed of heat-insulating material; a pressure-reducing pump 6, which extracts air; and a mesh 12, which supports foundry sand 10.

The principal member 4 is cylindrical with its upper surface open, while exhaust air pipe 8 of the pressure-reducing pump 6 is connected to its bottom. The interior of the combustion furnace 2 contains the foundry sand 10. The mesh 12 is fine enough to prevent the foundry sand 10 from passing through and falling down, while being gas-permeable and heat-resistant.

There follows a description of a method of regenerating the foundry sand 10 in the combustion furnace 2.

The foundry sand 10 which it is desired to regenerate is introduced into the combustion furnace 2 and packed on top of the mesh 12. It is packed uniformly so that there are no cavities which might form air passages. A burner or similar device 26 is used to ignite the upper surface of the foundry sand 10, after which the pressure-reducing pump 6 is operated and draws air through the exhaust air pipe 8. The whole upper surface of the foundry sand 10 is ignited. It ignites more easily if the pressure-reducing pump 6 is left running. The capacity of the pressure-reducing pump 6 is adjusted so that a prescribed amount of air passes through the packed foundry sand 10.

As the ignited foundry sand 10 burns fiercely and becomes red-hot, combustion 3 proceeds from the surface where it was ignited gradually downwards into the interior of the foundry sand 10. When combustion 3 reaches the mesh 12, the pressure-reducing pump 6 is stopped. Thus the resin component which had adhered around the foundry sand 10 is totally combusted, and the foundry sand 10 through which combustion 3 has passed turns a whitish colour and is regenerated as if it were fresh sand.

Figure 2:
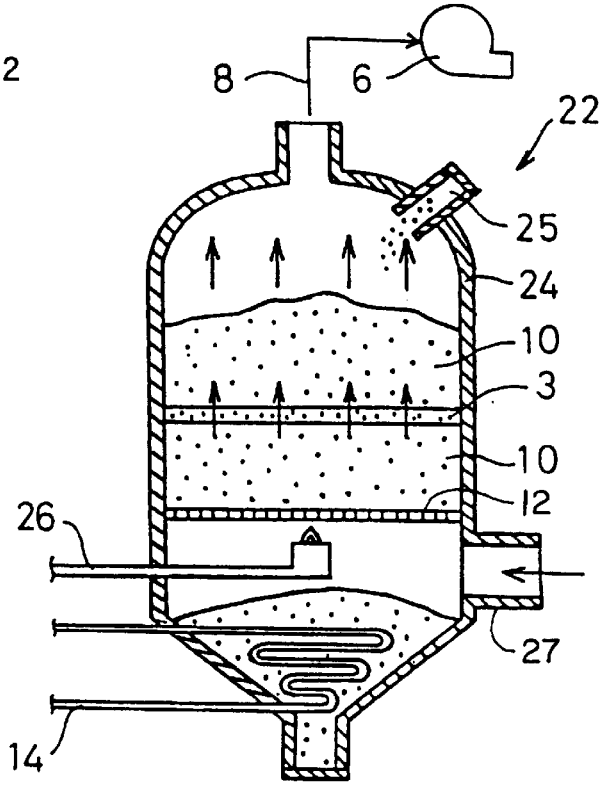
FIG. 2 is a cross-sectional diagram illustrating an embodiment of another regenerating device for the purpose of implementing the method of regenerating to which the present invention pertains.

FIG. 2 shows another embodiment of the combustion furnace. This combustion furnace 22 has the exhaust air pipe 8 of the pressure-reducing pump 6 connected to the top of the principal member 24, while the bottom of the combustion furnace 22 is provided with an air inlet 27, which is open. Towards the top of the principal member 24 there is an aperture 25 for introducing the foundry sand, while the burner 26 is fitted below the mesh 12.

In this configuration, the foundry sand 10 is introduced into the combustion furnace 22 through the aperture 25. Having been introduced, the foundry sand 10 is ignited by means of the burner 26. When the pressure-reducing pump 6 is operated, the foundry sand 10 ignites at the bottom, and combustion 3 rises gradually thanks to the air which is introduced through air inlet 27. The accretion is combusted and the foundry sand 10 regenerated. This is another good way of regenerating the foundry sand 10. Moreover, by selecting a suitable coarseness for the mesh 12 it is possible to ensure that unregenerated foundry sand 10 does not fall through the mesh 12 and only regenerated foundry sand 10 is allowed to pass through and fall down. Alternatively the reduced pressure can be utilised to retain the regenerated foundry sand 10 above the mesh 12, allowing it to fall through as a result of the fall in reduced pressure which occurs when the aperture 25 is opened and the pressure within the combustion furnace 22 rises. In this way the operation of regeneration can be performed continuously and the regenerated furnace sand 10 extracted automatically by replenishing at the top, thus making it possible to achieve an effective continuous regeneration process.

It is also possible to introduce air by boosting the pressure at the air inlet 27 to a degree at which the sand is not fluidised. Self-combustion occurs satisfactorily in the same way as when the pressure is reduced at the top, and it is possible to regenerate the foundry sand. Simultaneous pressure reduction and pressure boosting may also be applied. This serves to increase the speed of combustion and facilitates effective recycling.

It is also possible to fit a heat-exchanger 14 as shown in FIG. 2. Energy extracted by the heat-exchanger 14 is used to dry the foundry sand or for preheating. In particular, a large amount of energy is consumed for evaporating water where the foundry sand is wet, and combustion efficiency is greatly reduced as a result. By making use of energy extracted by the heat-exchanger 14 for the purpose of drying, it is possible to improve combustion efficiency. It is also feasible to operate an electricity generator with the energy extracted by the heat-exchanger 14, and to drive the pressure-reducing pump 6 with the electric power which is generated in this manner.

Figure 3:
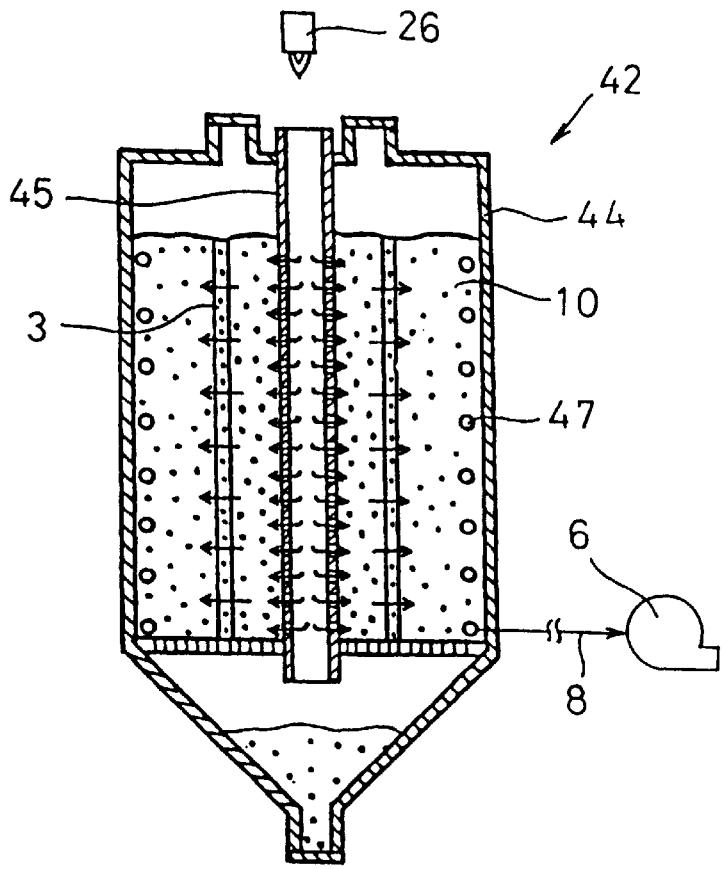
FIG. 3 is a cross-sectional diagram illustrating an embodiment of another regenerating device for the purpose of implementing the method of regenerating to which the present invention pertains.

FIG. 3 illustrates another embodiment.

This combustion furnace 42 has in the centre of the principal member 44 a pipe 45 in which there are numerous perforations, and on the perimeter of the principal member 44 a suction pipe 47. One end of the pipe 45 is open, while pipe 47 is connected to the pressure-reducing pump 6. The foundry sand 10 which it is desired to regenerate is introduced around pipe 44.

With this combustion furnace 42, a flame from the burner 6 is fed into the central pipe 44 and ignites the foundry sand 10 around the pipe 44. The pressure-reducing pump 26 is operated and the air extracted from around the combustion furnace 42 through pipe 47. Air is then introduced through the central pipe 44 and dispersed outwards within the foundry sand 10. Thus, having been ignited by the burner 26, the area of combustion 3 increases as it proceeds little by little cylindrically in an outward direction, with the result that recycling of the foundry sand 10 can be implemented in a short space of time even though the rate of progress of combustion 3 is uniform.

EXPERIMENTAL EXAMPLE 1

There now follows a description of an experiment example wherein foundry sand was combusted within a combustion furnace.

For the purpose of the experiment a mesh was fitted within an iron vessel, foundry sand was introduced above the mesh up to the top of the vessel, a pressure-reducing pump was connected to the bottom, and thermometers were placed on the side of the vessel at 5 cm intervals.

The vessel was cylindrical with an internal diameter of 280 mm and a height of 350 mm, and the thermometers were located so as to measure the centre of the vessel. The foundry sand used in the experiment weighed about 25 kg, with 3wt % of acid-setting self-hardening phenol carbides adhering to it.

The air permeability of the foundry sand contained within the vessel was 100, the maximum degree of pressure reduction of the pressure-reducing pump used was 2000 mmAq, the suction capacity was $4M^3$/min, and the degree of pressure reduction within the vessel when the pressure-reducing pump was operated was 50 mmAq. The mesh used had 5 mm perforations at 20 mm intervals. A gas burner was used for the purpose of ignition, and the whole of the upper surface of the foundry sand was ignited with the pressure-reducing pump running. Ignition took about 2 min.

There follows an explanation of the results of the experiment.

The surface of the foundry sand was ignited and combustion proceeded gradually downwards with the passage of time. It was possible to confirm the progress of the combustion from the changes in temperature recorded by the thermometers and the rising temperature of the side surface of the vessel. The rate of combustion was approximately 10 mm/min, and it required 32 min to reach the bottom of the vessel. The maximum temperature of combustion was approximately 1100° C., removal of the accretion through combustion was good, and it was possible to use the foundry sand after regeneration as if it were fresh sand. Carbide residue was less than 0.3%.

Figure 5:
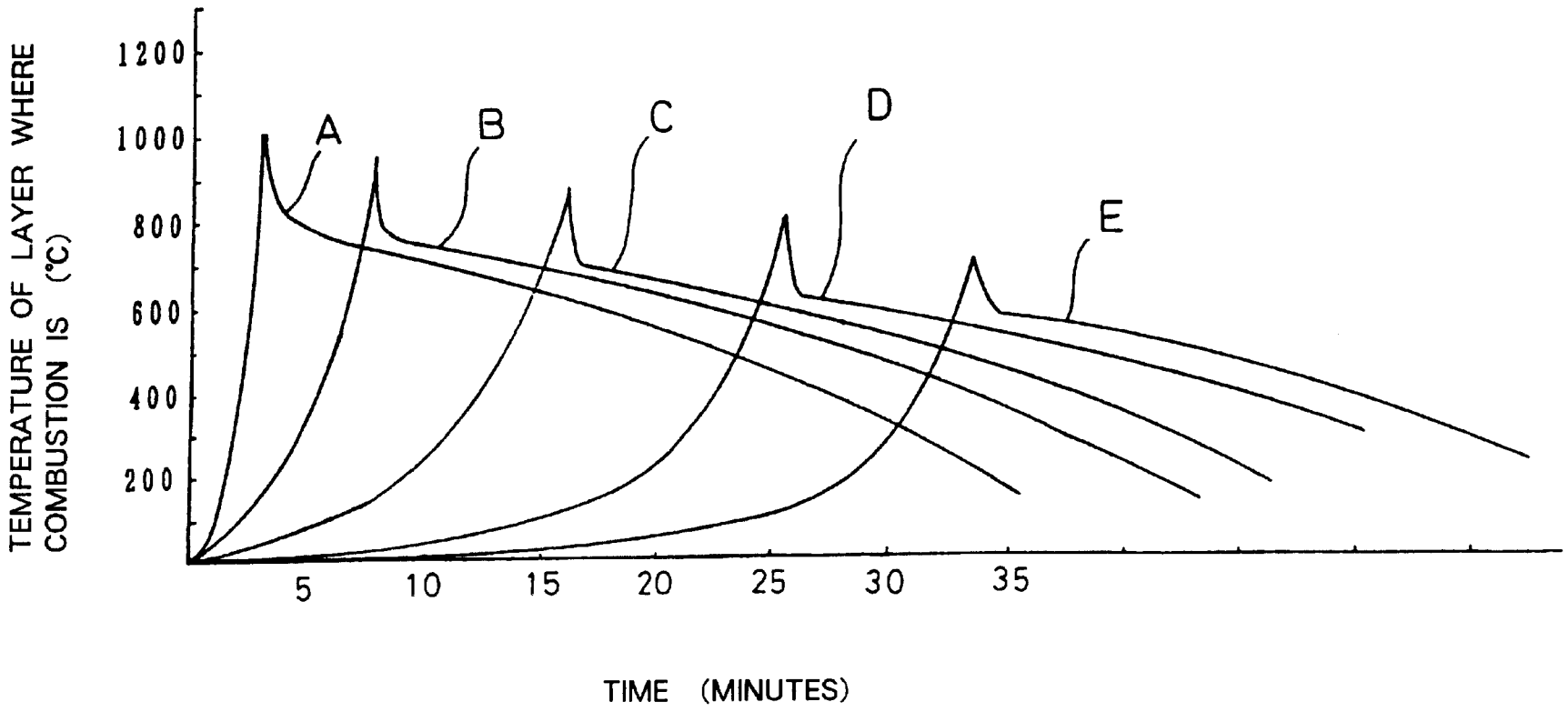
FIG. 5 is a graph showing the results of tests on the method of regenerating.

FIG. 5 shows the results of temperature measurements taken at each point. On the graph, A is the temperature as recorded directly below the surface, while B, C, D and E are those which were recorded by thermometers placed at 5 cm intervals. It will be seen that the temperature of the sand during combustion rises, while that immediately beneath does not, only rising rapidly once combustion begins. In fact, measurements of the temperature of the exhaust gas drawn off by the pressure-reducing pump recorded a maximum of 90° C.

It is thought that the reason why the temperature of the exhaust gas is not high is due to the influence of the carbon component which exists within the foundry sand. That is to say, oxygen introduced into the interior of the foundry sand as a result of pressure reduction participates in one of the following reactions with the carbon component.

| | | | |
|---|---|---|---|
| (1) | $C + O_2 = CO_2$ | +94.05 Kcal/mol | (exothermic) |
| (2) | $C + 1/2O_2 = CO$ | +26.40 Kcal/mol | (exothermic) |
| (3) | $2CO + O_2 = 2CO_2$ | +136.2 Kcal/mol | (exothermic) |
| (4) | $C + CO_2 = 2CO$ | −41.25 Kcal/mol | (endothermic) |

In a layer where there is sufficient supply of oxygen, exothermic reactions (1)–(3) occur, so that it becomes a combustion layer and the temperature rises. However, endothermic reaction (4) occurs immediately below a combustion layer because oxygen is already being consumed in the combustion layer. This is thought to be the reason why the temperature immediately below the combustion layer and that of the gas emitted as a result of pressure reduction is not high. In this respect, as a way of ensuring that the temperature of the gas emitted does not become any higher, it is thought to be important to create an uncombusted layer containing carbon between the combustion and the reduced pressure. As far as the required thickness of the uncombusted layer is concerned, there is no problem however thin it is, but the temperature of the gas emitted begins to rise gradually if this layer disappears. Even then, the temperature of the gas does not rise sharply. This means that even if the uncombusted layer disappears, combustion may be continued so long as no problem occurs in the pressure-reducing device or elsewhere. Consequently, with the present invention it is sufficient for an uncombusted layer to be in existence most of the time during combustion. Where pressure is boosted, it does not matter if gas of a somewhat higher temperature is generated because it is simply discharged from the system. However, in view of prolonging the life of the combustion furnace it is preferable for an uncombusted layer to be in existence most of the time during combustion.

Figure 4:
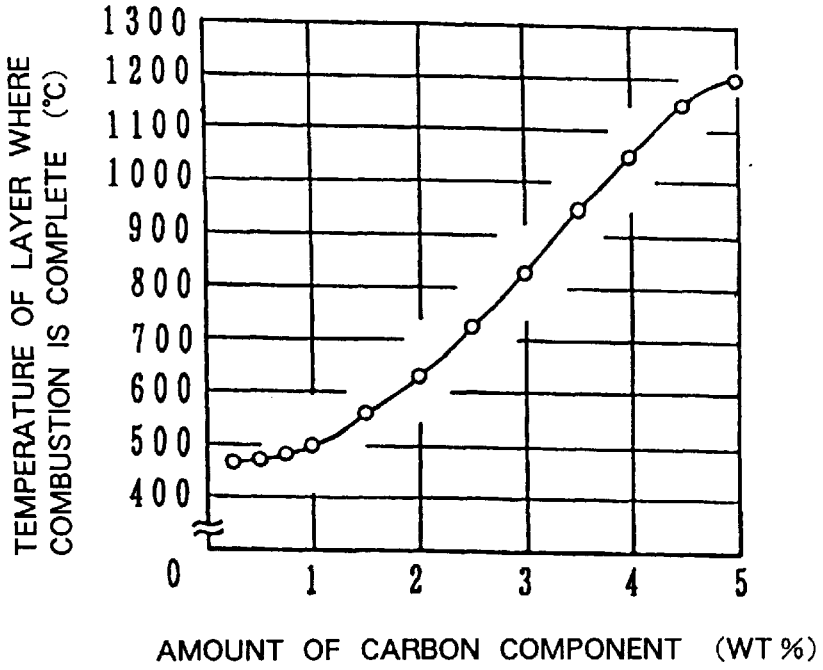
FIG. 4 is a graph showing the results of tests on the method of regenerating.

FIG. 4 is a graph showing the temperature immediately after combustion when the proportion of resin content was altered. The experiment involved altering the carbon content as necessary and measuring the temperature of the foundry sand after combustion was complete. The temperature immediately after combustion was complete was adopted because this temperature is maintained for a long time, and its thermal effect on the sand it is thought to be greater than that of the peak temperature, which is sustained only temporarily. In this way it is possible to alter the temperature of the foundry sand by altering the proportion of admixture of the accretion. The proportion of admixture of the accretion can be modified by mixing unregenerated sand with sand which has already been regenerated. It can also be achieved by altering the oxygen content within the gas.

The resin may be a furan, acid-setting phenol or alkali phenol resin, a similar organic caking agent or green sand mould.

Furthermore, using a combustion furnace, dust of green sand containing bentonite moulded in spherical, cylindrical and other shapes was mixed with foundry sand containing a carbon component and subjected to heat-treatment by heat of self-combustion of the foundry sand. Combustion of the dust was good, and it was possible to use the product in place of floor sand and the like. The same method was used to combust green wood, and the fact that the foundry sand served to cut off external oxygen allowed the production of fine-quality charcoal. Heat-treatment of other substances is also feasible using heat of self-combustion of foundry sand.

An experiment was conducted in the combustion furnace using grains of graphite instead of foundry sand, and it was found that they combust in exactly the same way as foundry sand. Shredded paper was used in a similar experiment, and it all turned into grey ash without the paper turning black as a result of lack of oxygen. In particular, reducing the pressure when combustion was almost complete allowed all the paper which had carbonised and turned black to change into grey ash, and its volume was reduced considerably.

Combustion by means of the present invention is feasible with any other air-permeable substance having a carbon component of 0.1 wt % or above.

INDUSTRIAL APPLICABILITY

The present invention makes it possible to regenerate foundry sand which has adhering to its surface resins employed in order to maintain the shape of the mould, and to use it as fresh sand. Moreover, this regeneration can be effected at low cost and with simple apparatus because the accretion adhering to the foundry sand is allowed to self-combust.

We claim:

1. A method of regenerating foundry sand, characterised in that a carbon accretion adhering to spent foundry sand is combusted and removed by placing the foundry sand in a combustion furnace which is connected on one side to a pressure-reducing pump and is open on the other, introducing air into the foundry sand through suction by means of the pressure-reducing pump while the accretion is ignited upwind of the air current, and allowing combustion of the accretion to proceed successively on the downwind side.

2. A method of regenerating foundry sand according to claim 1, characterised in that the pressure-reducing pump is connected to the lower part of the combustion furnace, and combustion of the accretion is allowed to proceed from the top towards the bottom of the foundry sand within the combustion furnace.

3. A method of regenerating foundry sand according to claim 1, characterised in that the pressure-reducing pump is connected to the upper part of the combustion furnace, and combustion of the accretion is allowed to proceed from the bottom towards the top of the foundry sand within the combustion furnace.

4. A method of regenerating foundry sand according to claim 1, characterised in that a pressure-reducing member connected to the pressure-reducing pump is fitted on to the perimeter of the combustion furnace while an air intake member is positioned in the centre of the combustion furnace, and combustion of the accretion is allowed to proceed outwards from the centre of the combustion furnace.

5. A method of regenerating foundry sand according to claim 1, characterised in that heat is applied from outside while combustion of the accretion is proceeding within the combustion furnace.

6. A method of regenerating foundry sand according to claim 5, characterised in that a pressure-boosting pump is fitted to the other side of the combustion furnace, and air is introduced into the combustion furnace by means of high-pressure air from the pressure-boosting pump, either alone or in combination with reduced-pressure air.

7. A method of regenerating foundry sand according to claim 6, characterised in that the accretion content within the foundry sand is modified, and the combustion temperature of the accretion is modified.

8. A method of regenerating foundry sand according to claim 7, characterised in that the air which is introduced into the combustion furnace is replaced by a gas containing a specified amount of oxygen.

9. A method of regenerating foundry sand according to claim 8, characterised in that foundry sand which has been heated through regenerating is mixed with foundry sand about to be regenerated.

10. A method of regenerating foundry sand according to claim 9, characterised in that a heat-exchanger is fitted within the combustion furnace, and heat of combustion from within the combustion furnace is led outside by means of the heat exchanger.

11. A method of regenerating foundry sand according to claim 10, characterised in that other substances are mixed with foundry sand about to be regenerated within the combustion furnace, and regenerated.

* * * * *